US005972283A

United States Patent [19]

Podobnik et al.

[11] Patent Number: 5,972,283

[45] Date of Patent: Oct. 26, 1999

[54] STABILIZED LADLE FOR METAL CASTING

[75] Inventors: Anton Podobnik; John Von Styp, both of Etobicoke, Canada

[73] Assignee: Chrysler Corporation, Auburn Hills, Mich.

[21] Appl. No.: 09/010,665

[22] Filed: Jan. 22, 1998

[51] Int. Cl.[6] ..... C21B 3/00

[52] U.S. Cl. ..... 266/275; 266/287; 222/358; 222/604

[58] Field of Search ..... 266/275, 287; 222/590, 358, 604

[56] References Cited

U.S. PATENT DOCUMENTS

| | | | |
|---|---|---|---|
| 3,556,354 | 1/1971 | Ott | 222/358 |
| 3,690,517 | 9/1972 | Ott | 222/358 |
| 4,289,259 | 9/1981 | O'Brien | 222/604 |

*Primary Examiner*—Scott Kastler
*Attorney, Agent, or Firm*—Lawerence J. Shurupoff

[57] ABSTRACT

A substantially constant resistive force is applied to the drive motor of an automated ladler arm to prevent jerky movement of the arm during a downward or descending portion of its travel from a furnace to a mold. The force may be applied through an air cylinder connected to a pivoting loader arm.

8 Claims, 3 Drawing Sheets

STABILIZED LADLE FOR METAL CASTING

BACKGROUND OF THE INVENTION

1. Field of the Invention

The present invention relates to automated apparatus for ladling molten metal from a furnace to a mold and particularly to the stabilization of such apparatus as it moves through a downward path of motion.

2. Description of the Prior Developments

Apparatus for automatically ladling molten metal from a furnace into a mold are well known in the art and are commercially available under the name of Rimlock Ladlers, for example. Although these ladlers generally function well, a problem arises when the ladle is required to move in a downward direction. In this case, the electric motor which drives the ladle arm must act as a break to prevent the ladle from accelerating downwardly.

If the ladle is allowed to fall quickly downward under gravity, the molten metal carried by the ladle will be sloshed about at its abrupt end of travel. This is most undesirable insofar as any turbulent motion induced in the molten metal encourages the formation of oxides which create stress risers in the cast end product.

One approach to avoiding such turbulence is to operate the ladle at a relatively slow speed. Unfortunately, slow speed operation of the automatic ladler causes a drop in production rates as well as a significant drop in temperature of the molten metal carried by the ladle from a furnace to a mold.

Temperature loss in excess of 50° F. in the molten metal is typically accounted for by raising the temperature of the metal in the furnace by 50° to 100° F. This also has a drawback since higher melt temperatures also facilitate the formation of oxides.

Although existing ladlers can be adapted to produce a downward path of motion, the negative load applied to the electric motor driving the ladler during such motion causes the motor to "hunt" or rapidly reverse direction. This hunting results in a jerky movement of the ladle arm and thereby induces turbulent motion in the molten metal carried in the ladle.

Again, such turbulence fosters the formation of oxides in the molten metal. In the case of a piston casting operation, molten aluminum silicon alloys quickly form highly undesirable aluminum oxides in the melt.

Accordingly, a need exists for an automatic ladler which provides smooth motion throughout its travel and which prevents the ladler drive motor from hunting and jerking the ladle arm during downward movement of the ladle arm. A further need exists for such a ladler which may be operated at high production rates and which minimizes the loss of temperature in the molten metal during its travel from a furnace to a mold.

SUMMARY OF THE INVENTION

The present invention has been developed to fulfill the needs noted above and therefore has as an object the provision of a stabilized ladler which may be operated at relatively high speeds, even during downward motion of the ladle, and which avoids hunting of the ladler drive motor and jerky movements of the ladle as the ladle descends under the force of gravity.

These and other objects are met by the present invention which applies a smooth, substantially constant resistance to the ladle arm during its downward portion of travel toward a mold. The resistance is preferably applied by an air cylinder and linkage assembly attached to the ladler. A roller, mounted on the free end of a pivot link, engages the ladle arm as it begins its downward motion.

The amount of resistance applied against the ladle arm is selected at a value which at least equals or slightly exceeds the gravity induced force applied to the ladler drive motor by the weight of the ladler arm linkage and filled ladle as the ladle travels downwardly toward a mold. In this manner, a positive load is applied to the ladler drive motor throughout its operation and thereby eliminates any need for the motor to apply a breaking force. Preferably, the resistance applied to the drive motor is substantially constant so that the motor drives the ladle at a constant velocity.

DETAILED DESCRIPTION OF THE PREFERRED EMBODIMENT

Figure 1:
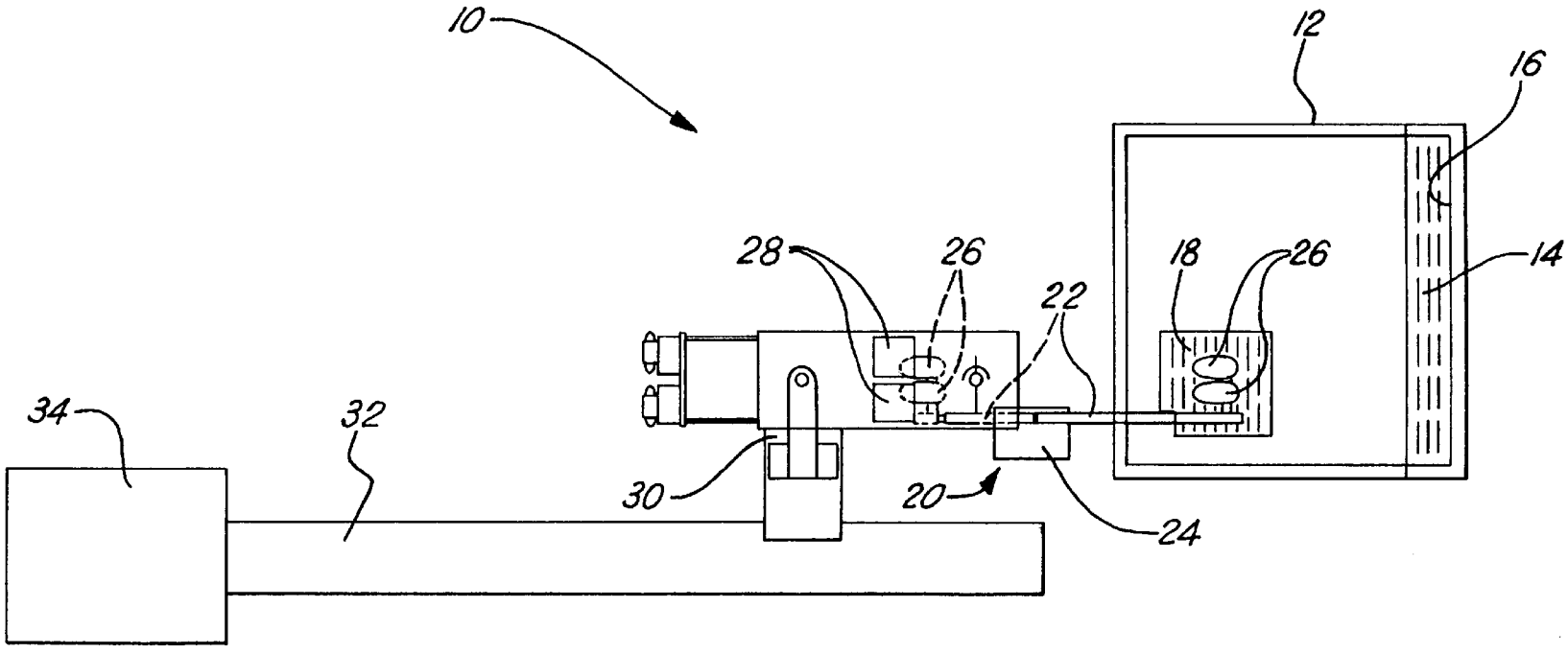
FIG. 1 is a schematic top plan view of a casting operation having a conventional automatic ladler modified in accordance with the invention and showing a ladle arm and ladles at two extreme endpoints of travel.

The present invention will now be described in conjunction with the drawings beginning with FIG. 1 which shows a manufacturing setup 10 for casting aluminum alloy pistons. A holding furnace 12 receives through an opening 16 a charge of molten metal alloy 14 from a crucible, chute or other means customary in the casting industry. The furnace 12 includes an open well 18 from which the molten alloy 14 may be scooped by an automated ladling machine or ladler 20.

Ladler 20 includes an arm 22 driven by an electric motor housed in console 24. A pair of scoops or ladles 26 is attached to the end of arm 22 for transferring measured amounts of molten alloy 14 from the open well 18 of furnace 12 to a pair of molds 28. The arm 22 and ladles 26 are shown schematically at their extreme points of travel for the purpose of illustration.

A chute 30 is provided for receiving solidified cast pistons automatically unloaded from molds 28. A conveyor 32 transfers the pistons to a bin 34 for storage prior to machining. Up to this point, the description of setup 10 is of conventional design. However, due to manufacturing constraints, it has been found necessary to move the ladles 26 over a generally arch-shaped path from the furnace 12 to the molds 28. Because the ladles 26 must travel over a downward path as they approach the molds 28, the problems noted above require the provision of the stabilizing assembly discussed in detail below.

Figure 2:
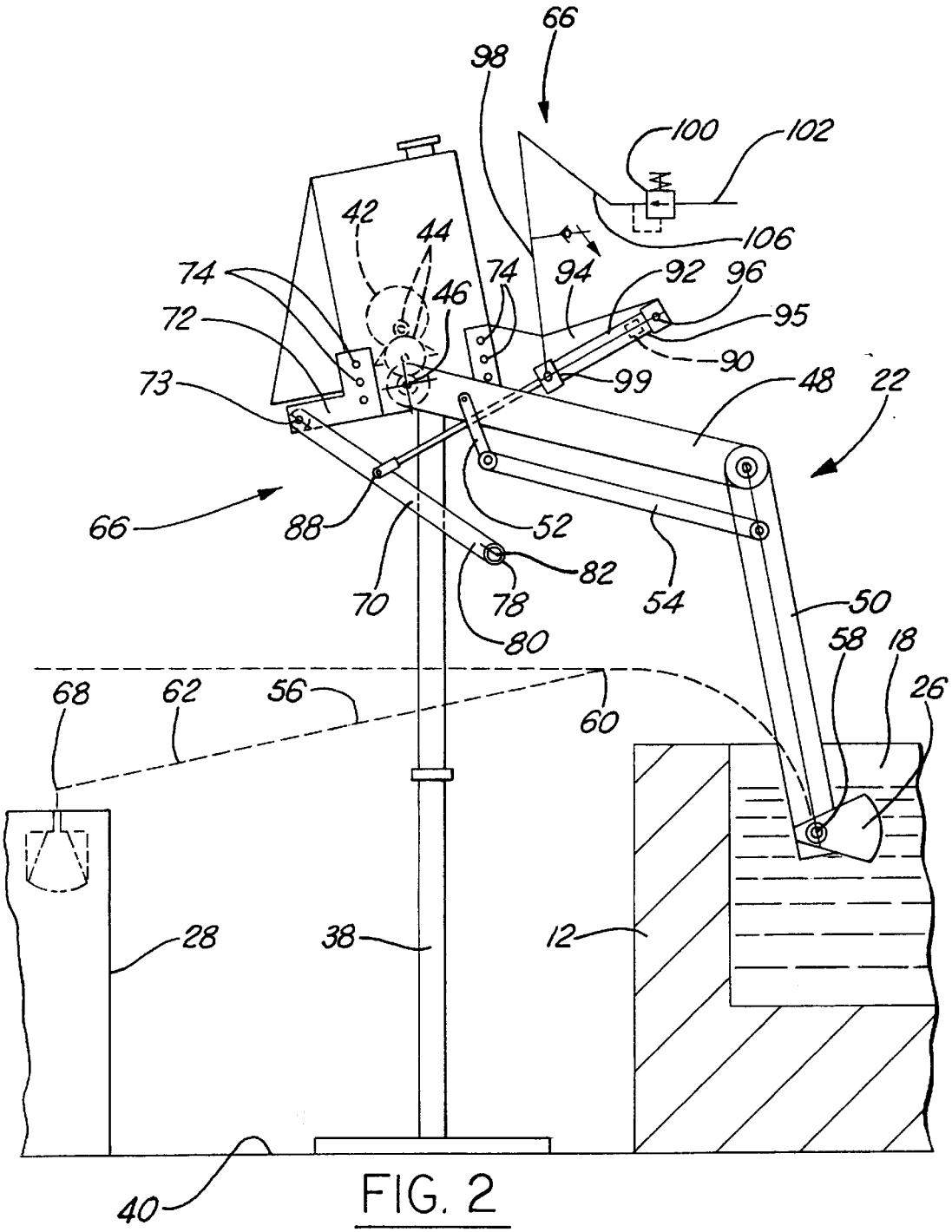
FIG. 2 is a schematic front elevation view of a conventional ladler of the type shown in FIG. 1 and showing the details of a stabilizing assembly constructed in accordance with the invention. The ladler is depicted at the beginning of its motion cycle where it is disengaged from the stabilizing assembly.

As seen in FIG. 2, the ladler 20 includes a stand 38 for elevating console 24 above shop floor 40 and elevating arm 22 above the furnace 12. As shown in phantom, an electric motor 42 is connected by gears 44 to drive shaft 46 of arm 22 to pivot arm 22 between the furnace 12 and molds 28.

Arm 22 is constructed in a known fashion as a linkage having a drive arm 48 pivotally mounted on the exterior of console 24 and geared to motor 42. A ladle arm 50 is pivotally connected at one end to drive arm 48 and supports a pair of ladles 26 at its opposite free end.

A short link 52 is pivotally connected at its inner end to the drive arm 48 and at its outer end to the inner end of a support arm 54. The outer end of support arm 54 is pivotably connected to the inner end portion of the ladle arm 50.

By adjusting the console 24 relative to stand 38, the travel path of ladle 26 can be adjusted. As shown by the dashed line in FIG. 2, the ladle's path of travel 56 can be defined as a portion of an arch from its startpoint 58 inside furnace well 18 up to its highest point or apex at 60. During this portion of travel, motor 42 is positively under load and can smoothly and quickly lift the ladles 26 filled with molten metal up to apex 60.

However, once each ladle 26 passes point 60 and begins descending downwardly along the linear ramped or inclined portion 12 of path 56, the weight of the arm 22, combined with the weight of the laden ladles, unloads motor 42 and causes it to accelerate, overrun and hunt. In order to prevent this condition, a stabilizing assembly 66 has been developed to provide a substantially constant resistance or retarding force against arm 22. This force is preferably applied beginning at apex 60 and throughout the ladles' descent along ramped portion 62 to their lowest end point 68 where the ladles are tipped to pour molten metal alloy 14 into molds 28.

Stabilizing assembly 66 includes a loader arm 70 pivotally connected to the front panel of console 24 via a pin joint 73 on mounting bracket 72. Bracket 72 is fixed to console 24 by any suitable means such as bolts 74. A roller or wheel 78 is rotatably mounted to one side of the free end 80 of loader arm 70 by a stub shaft 82.

The roller 78 on loader arm 70 is aligned to intermittently engage the arm 22 by abutting and rolling along the lower surface 84 of support arm 54. A predetermined, preferably constant, resistance is thereby applied to the downward movement of arm 22 and ladles 26 by loader arm 70.

The resistance applied by loader arm 70 is provided through rod 86 which is pivotally connected to a central portion of arm 70 at pin joint 88. Rod 86 is connected to a piston 90 which is slidably mounted within air cylinder 92.

A cylinder mounting bracket 94 is fixed to the front panel of console 24 such as by bolts 74. The open end 95 of air cylinder 92 is pivotally mounted to the bracket 94 by a pinned joint such as clevis joint 96.

As pressurized air line 98 is connected to the rod end 99 of cylinder 92 for biasing and driving piston 90 toward the open end 95 of cylinder 92. The air pressure level in air line 98 is regulated by a conventional relieving air line pressure regulator 100 which may receive shop air 102 at 75 psi and provide a regulated constant pressure supply of air flowing into and exhausting from air cylinder 92 at, for example, 45 psi.

An optional flow control valve can be provided in the regulated pressure line 106 to control the flow volume of air through air line 98. As the loader arm is driven toward the mold 28 by arm 22, the loader arm pulls piston 90 from open end 95 toward rod end 99 via rod 86, air at constant pressure is driven back through line 98, and exhausted through relieving regulator 100.

In operation, arm 22 is lowered into open well 18 so as to fill ladles 26 with molten metal alloy 14. The arm 22 is then driven by motor 42 along an arcuate path from startpoint 58 to apex 60. During this portion of travel, arm 22 travels freely without contact with the stabilizing assembly 66.

As the ladles 26 begin their descent toward molds 28 from apex 60, the roller 78 on loader arm 70 is aligned so that it engages the bottom of support arm 54 and provides a substantially constant supplemental loading on drive motor 42. Ideally, the force applied by the stabilizing assembly 66 to arm 22 results in the ladles 26 descending to end point 68 from apex 60 at an unaccelerated rate, i.e., at constant velocity. Thus, a substantially constant velocity can be achieved by a careful selection of linkage pivot points on assembly 66, and selection of regulated air line pressure with the setting on regulator 100.

Figure 3:
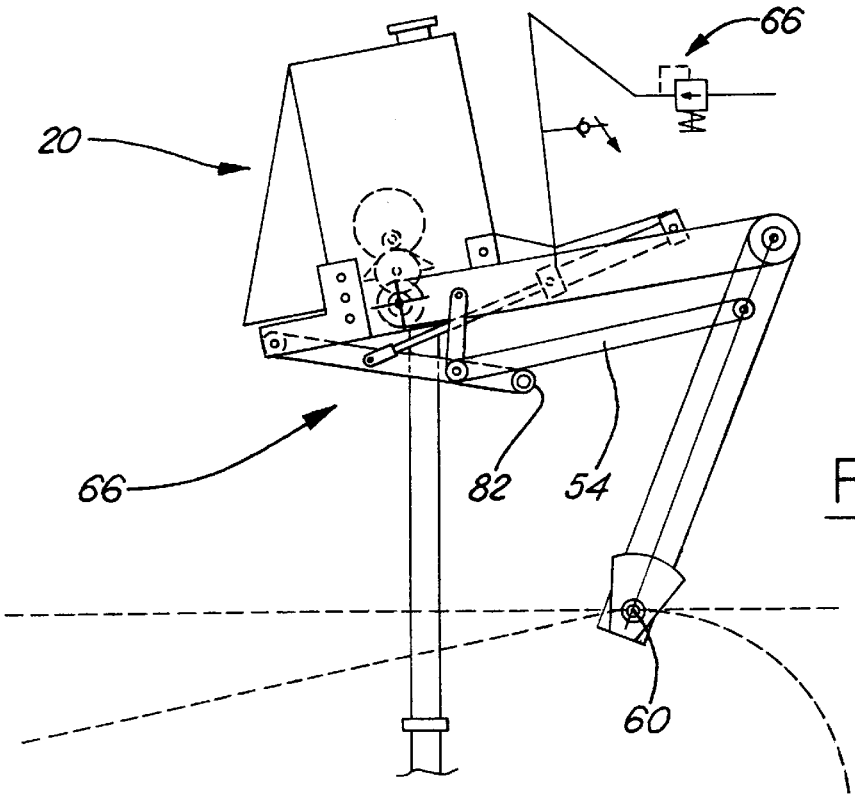
FIGS. 3 and 4 are views similar to FIG. 2 but depicting the ladler at the beginning of its downward path of motion and engaged with the stabilizing assembly.
Figure 4:
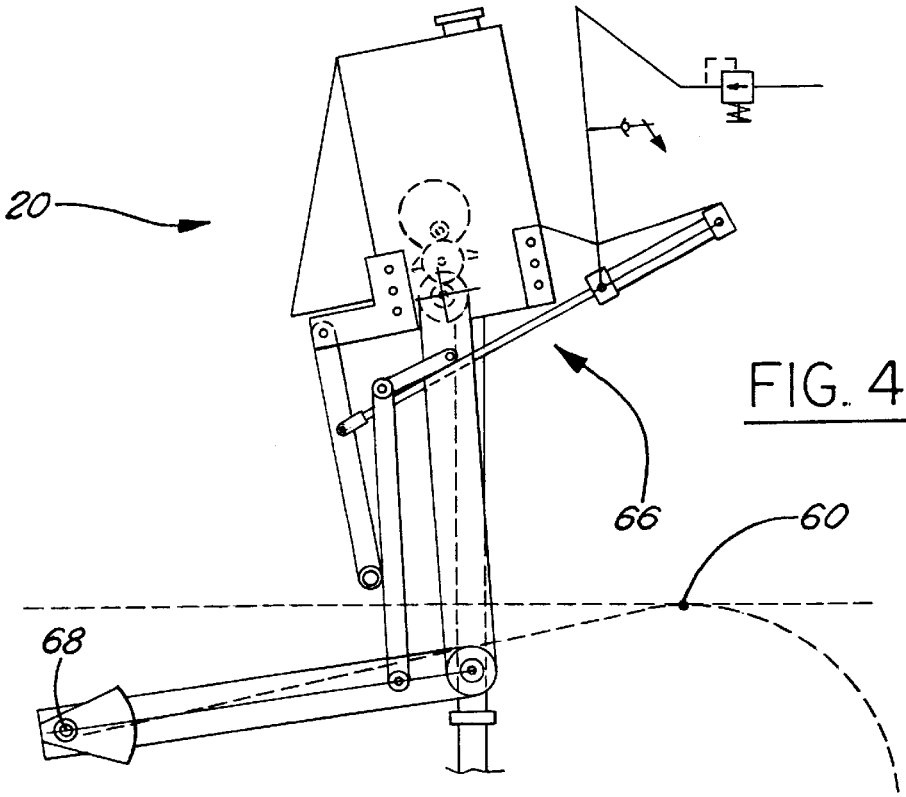

When the ladles reach end point 68 as shown in FIG. 3, they are tipped toward the molds and thereby pour their molten alloy into the molds. At this point, the motor 42 drives arm 22 back to its opposite extreme position with ladles 26 again positioned as shown in FIG. 2. As the arm 22 returns toward furnace 12, rod 86 is driven back into air cylinder 92 by the air pressure supplied through air line 98 until arm 22 reaches its innermost position corresponding to the position shown in FIG. 2. Rolling contact between roller 78 and support arm 54 is broken when ladles 26 pass apex 60 and begin their descent into open well 27. At this point 58, the cycle repeats itself.

The addition of stabilizing assembly 66 to ladler 20 reduces oxide formation in the molten alloy and thereby reduces scrapped parts previously rejected due to foreign oxide inclusions. This is achieved by eliminating oxide formation created by turbulence by ensuring a smooth downward motion of ladles 26 along a linear ramped path of motion. Cycle times are also reduced by about 15 percent with the added benefit of a lower temperature drop in the molten metal from the holding furnace to the molds.

That is, prior temperature drops of around 80° F. have been reduced to about 25° F. using the stabilizing assembly 66. This enables a better temperature control in the melt and thereby reduces scrap due to unacceptable porosity levels.

It should be understood that while this invention has been discussed in connection with one particular example, those skilled in the art will appreciate that other modifications can be made without departing from the spirit of this invention after studying the specification, drawings, and the following claims.

We claim:

1. A stabilizer assembly for stabilizing movement of a ladler arm mounted to a metal casting ladler, said assembly comprising:

an electric motor driving said ladler arm along a path over which said motor is loaded and unloaded by gravity force;

a loader arm adapted to engage with and disengage from said ladler arm;

an air cylinder having a rod and a piston slidably mounted therein, said piston connected to said rod; and a source of pressurized air communicating with said air cylinder and biasing said piston so as to apply a force against said ladler arm with said loader arm to counteract said gravity force which unloads said motor.

2. The assembly of claim 1, further comprising a pressure regulator communicating with said source of pressurized air for providing a regulated air pressure supply to said air cylinder.

3. The assembly of claim 1, further comprising a roller rotatably mounted on said loader arm for rolling on said ladler arm.

4. The assembly of claim 1, wherein said loader arm has a first end portion pivotally connected to said ladler and a second free end portion engaging said ladler arm.

5. The assembly of claim 1, wherein said air cylinder has a first end portion pivotally connected to said ladler and wherein said rod is pivotally connected to said loader arm.

6. The assembly of claim 1, wherein said path has first and second opposite end points and an apex therebetween and wherein said loader arm engages said ladler arm during travel of said ladler arm from said apex to said second end point.

7. The assembly of claim 6, wherein said loader arm is spaced apart from contact with said ladler arm during travel of said ladler arm from said first end point to said apex.

8. The assembly of claim 1, wherein said loader arm is biased by said air cylinder rod so as to apply a substantially constant force against said ladler arm during a portion of said movement.

* * * * *